US011260353B2

(12) United States Patent
Bamagain et al.

(10) Patent No.: US 11,260,353 B2
(45) Date of Patent: Mar. 1, 2022

(54) SYSTEMS AND METHODS FOR TREATING VISCOUS MEDIA

(71) Applicant: Saudi Arabian Oil Company, Dhahran (SA)

(72) Inventors: Rami A. Bamagain, Khobar (SA); Bandar A. Fadhel, Dhahran (SA); Ahmad D. Hammad, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 470 days.

(21) Appl. No.: 16/411,288

(22) Filed: May 14, 2019

(65) Prior Publication Data

US 2020/0360877 A1 Nov. 19, 2020

(51) Int. Cl.

| | |
|---|---|
| ***B01F 5/00*** | (2006.01) |
| ***B01F 3/08*** | (2006.01) |
| ***B01F 5/02*** | (2006.01) |

(52) U.S. Cl.

CPC ..... *B01F 5/0062* (2013.01); *B01F 3/088* (2013.01); *B01F 3/0865* (2013.01); (Continued)

(58) Field of Classification Search

CPC ..... B01F 5/0062; B01F 3/0865; B01F 3/088; B01F 5/0206; B01F 2005/0017; B01F 2215/0036; B01F 2215/0081

See application file for complete search history.

(56) References Cited

U.S. PATENT DOCUMENTS

| | | | |
|---|---|---|---|
| 2,592,904 | A | 4/1952 | Jackson |
| 6,041,944 | A | 3/2000 | Meier |

(Continued)

FOREIGN PATENT DOCUMENTS

| | | | |
|---|---|---|---|
| AT | 279508 | B | 3/1970 |
| CN | 108067120 | A | 5/2018 |

(Continued)

OTHER PUBLICATIONS

International Aluminium Institute (IAI), "Bauxite Residue Management: Best Practice", Jul. 2015, World Aluminum, 31 pgs.

(Continued)

*Primary Examiner* — Anshu Bhatia

(74) *Attorney, Agent, or Firm* — Dinsmore & Shohl, LLP

(57) ABSTRACT

Systems for treating a viscous medium are illustrated. The systems may comprise a primary source of pressurized treatment fluid, a fluidic transfer assembly, and a helical mixing element. The fluidic transfer assembly comprises a fluidic transfer chamber and a fluid outlet. The primary source of pressurized treatment fluid is in fluidic communication with the fluid outlet of the fluidic transfer assembly via the fluidic transfer chamber. The primary source of pressurized treatment fluid is in fluidic communication with the fluid outlet of the fluidic transfer assembly via the fluidic transfer chamber. The helical mixing element comprises an interior treatment fluid passage and external injection ports. The fluid outlet of the fluidic transfer assembly is in fluidic communication with the external injection ports of the helical mixing element via the interior treatment fluid passage of the helical mixing element. The systems may be incorporated into methods for treating a viscous medium.

20 Claims, 2 Drawing Sheets

(52) U.S. Cl.
CPC .... *B01F 5/0206* (2013.01); *B01F 2005/0017* (2013.01); *B01F 2215/0036* (2013.01); *B01F 2215/0081* (2013.01)

(56) References Cited

U.S. PATENT DOCUMENTS

| | | | | |
|---|---|---|---|---|
| 6,293,121 | B1 | 9/2001 | Labrador | |
| 6,488,402 | B1 * | 12/2002 | King | B01F 3/0446 366/173.2 |
| 6,694,867 | B1 | 2/2004 | Roth | |
| 8,785,808 | B2 | 7/2014 | Foret | |
| 9,023,301 | B2 | 5/2015 | Boudreault et al. | |
| 2004/0244382 | A1 * | 12/2004 | Hagen | F23L 7/00 60/775 |
| 2005/0056313 | A1 * | 3/2005 | Hagen | B01F 5/0453 137/3 |
| 2006/0032486 | A1 | 2/2006 | Prasad | |
| 2010/0276819 | A1 * | 11/2010 | Teng | B01F 5/0646 261/31 |
| 2011/0247816 | A1 | 10/2011 | Carter, Jr. | |
| 2014/0356262 | A1 | 12/2014 | Ruth et al. | |
| 2017/0120193 | A1 | 5/2017 | Zhang | |
| 2017/0369762 | A1 | 12/2017 | Martinez et al. | |

FOREIGN PATENT DOCUMENTS

| | | | |
|---|---|---|---|
| CN | 108607426 | A | 10/2018 |
| CN | 109663536 | A | 4/2019 |
| DE | 2805144 | B1 | 6/1979 |
| EP | 1602671 | A1 | 12/2005 |
| FR | 941828 | A | 1/1949 |
| GB | 569143 | A | 5/1945 |
| WO | 9711034 | A1 | 3/1997 |

OTHER PUBLICATIONS

Shi et al., "Carbon Dioxide Sequestation via pH Reduction of Red Mud Using Liquid CO2", Chemical and Petroleum Engineering, 5 pgs.

Venancio et al., "Pilot Test of Bauxite Residue Carbonation With Flue Gas.", TMS (The Minerals, Metals & Materials Society), 2013, 2 pgs.

Stanford, "Red mud—addressing the problem", Aluminium Insider, Nov. 2016, 4 pgs.

Goodarznia et al., "Treatment of Oil-Contaminated Drill Cuttings of South Pars Gas Field in Iran Using Supercritical Carbon Dioxide", Iranian Journal of Science & Technology, 2006, 5 pgs.

International Search Report and Written Opinion pertaining to Application No. PCT/US2019/051006 dated Feb. 6, 2020.

* cited by examiner

SYSTEMS AND METHODS FOR TREATING VISCOUS MEDIA

BACKGROUND

The present disclosure generally relates to systems and methods for treating viscous media.

BRIEF SUMMARY

According to the subject matter of the present disclosure, systems and methods for treating a viscous medium are provided where a helical mixing element is mechanically coupled to rotate with a rotational fluidic transfer assembly to facilitate treatment of the viscous media.

In accordance with one embodiment of the present disclosure, a system for treating a viscous medium comprises a primary source of pressurized treatment fluid, a rotational fluidic transfer assembly, and a helical mixing element. The rotational fluidic transfer assembly comprises an anchored portion, a rotational portion, a fluidic transfer chamber, a fluid outlet, and a sealed bearing assembly collectively configured to permit rotation of the rotational portion about a rotational axis relative to the anchored portion while maintaining a minimum fluidic injection pressure within the fluidic transfer chamber. The primary source of pressurized treatment fluid is in fluidic communication with the fluid outlet of the rotational fluidic transfer assembly via the fluidic transfer chamber. The helical mixing element comprises an interior treatment fluid passage, external injection ports, and external mixing paddles. The fluid outlet of the rotational fluidic transfer assembly is in fluidic communication with the external injection ports of the helical mixing element via the interior treatment fluid passage of the helical mixing element. The helical mixing element is mechanically coupled to rotate with the rotational portion of the rotational fluidic transfer assembly In accordance with another embodiment of the present disclosure, the primary source of pressurized treatment fluid, the rotational fluidic transfer assembly, and the helical mixing element cooperate to permit the injection of pressurized treatment fluid from the primary source of pressurized treatment fluid through the external injection ports of the helical mixing element, into a target viscous medium in which the helical mixing element is positioned and to rotate the helical mixing element in the target viscous medium simultaneously with the injection of the pressurized treatment fluid into the target viscous medium. The viscous medium comprises bauxite tailings, the pressurized treatment fluid comprises carbon dioxide, and the pressurized treatment fluid is injected into the viscous medium at a volumetric flow rate sufficient to decrease the pH of the viscous medium by at least 3.

In accordance with another embodiment of the present disclosure, a system for treating a viscous medium comprises a primary source of pressurized treatment fluid, a fluidic transfer assembly, and a helical mixing element. The fluidic transfer assembly comprises a fluidic transfer chamber and a fluid outlet. The primary source of pressurized treatment fluid is in fluidic communication with the fluid outlet of the fluidic transfer assembly via the fluidic transfer chamber. The helical mixing element comprises an interior treatment fluid passage and external injection ports. The fluid outlet of the fluidic transfer assembly is in fluidic communication with the external injection ports of the helical mixing element via the interior treatment fluid passage of the helical mixing element.

In accordance with another embodiment of the present disclosure, a method for treating a viscous medium is illustrated comprising submerging a system comprising a primary source of pressurized treatment fluid, a rotational fluidic transfer assembly, and a helical mixing element into the viscous medium and introducing pressurized treatment fluid to the system. The rotational fluidic transfer assembly comprises an anchored portion, a rotational portion, a fluidic transfer chamber, a fluid outlet, and a sealed bearing assembly collectively configured to permit rotation of the rotational portion about a rotational axis relative to the anchored portion while maintaining a minimum fluidic injection pressure within the fluidic transfer chamber. The primary source of pressurized treatment fluid is in fluidic communication with the fluid outlet of the rotational fluidic transfer assembly via the fluidic transfer chamber. The helical mixing element comprises an interior treatment fluid passage, external injection ports, and external mixing paddles. The fluid outlet of the rotational fluidic transfer assembly is in fluidic communication with the external injection ports of the helical mixing element via the interior treatment fluid passage of the helical mixing element. The helical mixing element is mechanically coupled to rotate with the rotational portion of the rotational fluidic transfer assembly. The pressurized treatment fluid comprises carbon dioxide. The target viscous medium comprises bauxite tailings and has a pH between approximately 10 and approximately 13 before it is treated with the pressurized treatment fluid.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
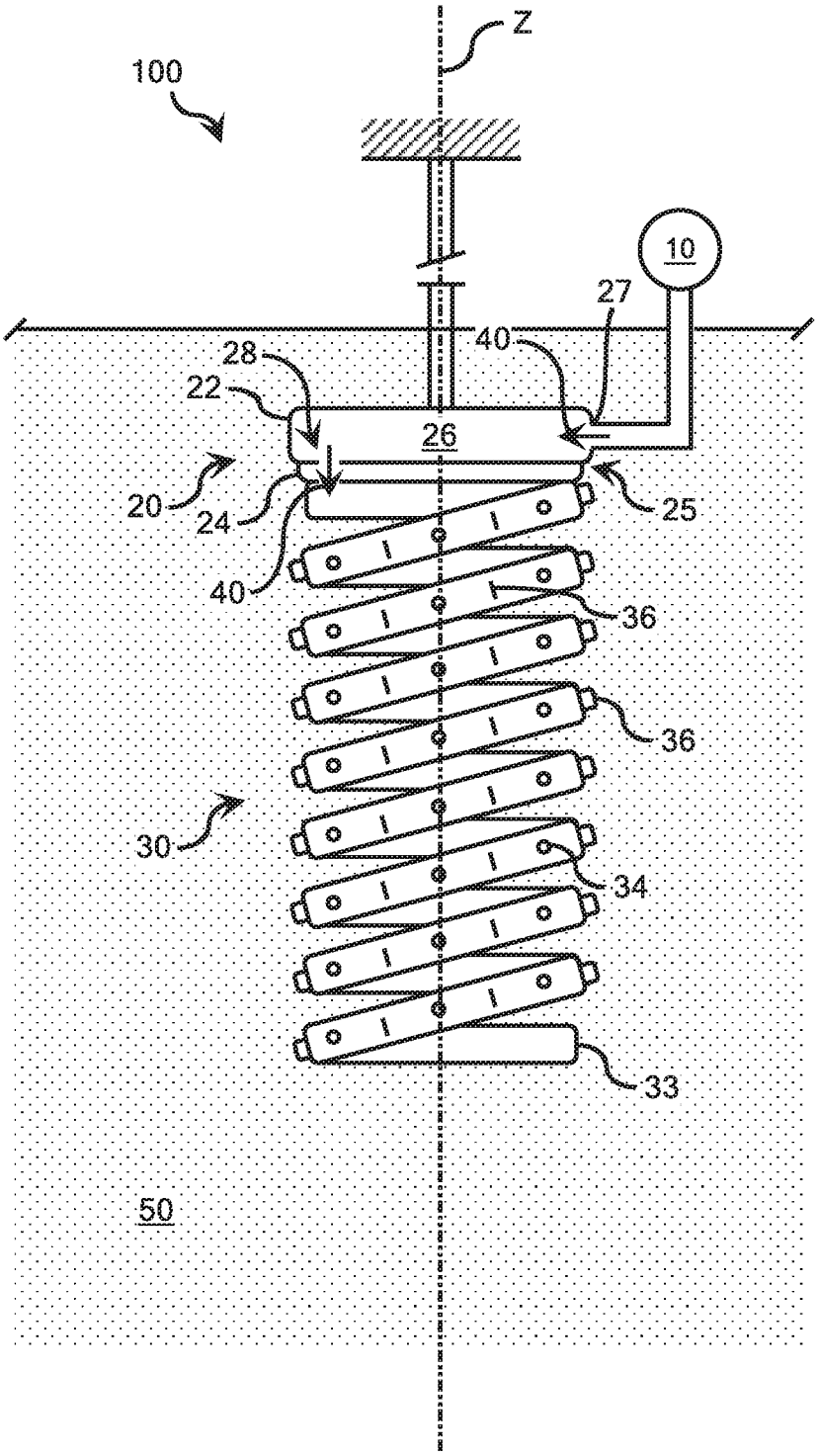
FIG. 1 illustrates a system for treating a viscous medium according to one embodiment of the present disclosure.

Referring initially to FIG. 1, a system 100 for treating a viscous medium according to the present disclosure is illustrated. The system 100 comprises a primary source of pressurized treatment fluid 10, a rotational fluidic transfer assembly 20, and a helical mixing element 30. The primary source of the pressurized treatment fluid 10, which is described in further detail below, may originate from a pressurized storage vessel or may be introduced with the aid of a fluid pump. It is contemplated that the pressurized treatment fluid 40 may be a gas, liquid, vapor, or multiphase solution that is suitable for treating the target viscous medium 50.

The rotational fluidic transfer assembly 20 comprises an anchored portion 22, a rotational portion 24, a fluidic transfer chamber 26, a fluid outlet 28, and an internal sealed bearing assembly 25 that are collectively configured to permit rotation of the rotational portion 24 about a rotational axis Z relative to the anchored portion 22 while maintaining a minimum fluidic injection pressure $P_{min}$ within the fluidic transfer chamber 26. For the purposes of defining and describing the subject matter of the present disclosure, it is noted that the sealed bearing assembly of the rotational fluidic transfer assembly 20 may be any type of conventional or yet to be developed bearing assembly that permits rotation of the rotational portion 24 about a rotational axis Z relative to the anchored portion 22 while maintaining a minimum fluidic injection pressure within the fluidic transfer chamber 26. For example, and not by way of limitation, it is contemplated that the suitable minimum fluidic injection pressure $P_{min}$ will be at least approximately two bar. As the size of the system 100 increases, the minimum fluidic injection pressure $P_{min}$ may be accordingly increased to compensate for the larger volume of the pressurized treatment fluid 40 needed to rotate the rotational fluidic transfer assembly 20. Therefore, in embodiments, the minimum fluidic injection pressure $P_{min}$ may range from two bar to hundreds of bar.

The primary source of pressurized treatment fluid 10 is in fluidic communication with the fluid outlet 28 of the rotational fluidic transfer assembly 20 via the fluidic transfer chamber 26. The helical mixing element 30 comprises an interior treatment fluid passage 32, external injection ports 34, and external mixing paddles 36. The fluid outlet 28 of the rotational fluidic transfer assembly 20 is in fluidic communication with the external injection ports 34 of the helical mixing element 30 via the interior treatment fluid passage 32 of the helical mixing element 30. The helical mixing element 30 is mechanically coupled to rotate with the rotational portion 24 of the rotational fluidic transfer assembly 20.

Figure 2:
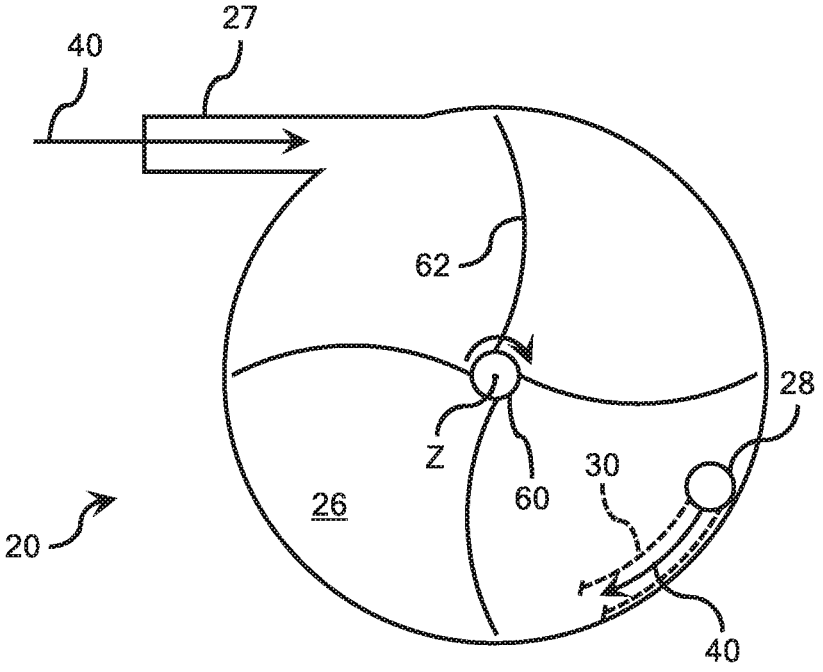
FIG. 2 illustrates a rotational fluidic transfer assembly of a system for treating a viscous medium according to one embodiment of the present disclosure.
Figure 3:
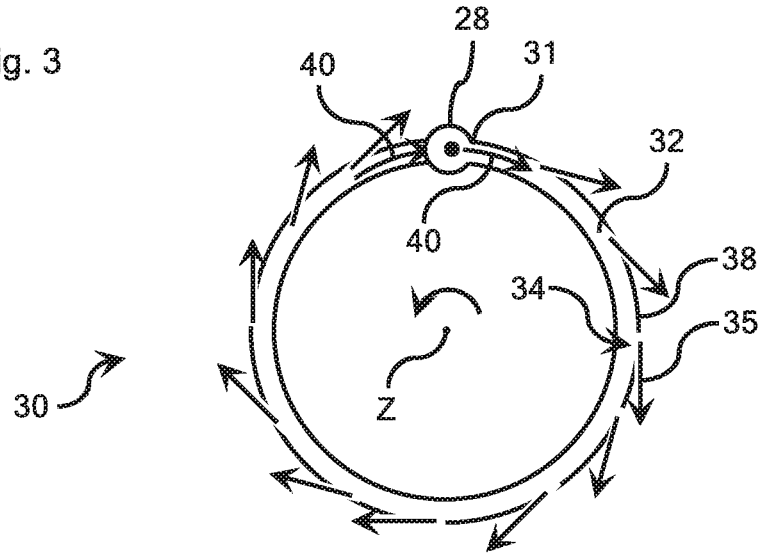
FIG. 3 illustrates a helical mixing element of a system for treating a viscous medium according to one embodiment of the present disclosure.

FIGS. 2 and 3 illustrate two different mechanisms by which the primary source of pressurized treatment fluid 10, the rotational fluidic transfer assembly 20, and the helical mixing element 30 may cooperate to rotate the helical mixing element 30 in the target viscous medium 50 in which the helical mixing element 30 is positioned while permitting the injection of pressurized treatment fluid 40 through the external injection ports 34 of the helical mixing element 30 into the target viscous medium 50. The resulting rotation of the helical mixing element 30 increases mass transfer between the pressurized treatment fluid 40 and the target viscous medium 50, thereby facilitating treatment of the target viscous medium 50.

Referring initially to FIG. 2, it is noted that the rotational portion 24 of the rotational fluidic transfer assembly 20 may comprise a pressure-driven impeller 60, and the primary source of pressurized treatment fluid 10 and the pressure-driven impeller 60 can be collectively configured to drive rotation of the helical mixing element 30 in response to the introduction of the pressurized treatment fluid 40 into the rotational fluidic transfer assembly. The rotational fluidic transfer assembly 20 may further comprise a flow-directing pressurized fluid inlet 27 that is configured to direct flow of the pressurized treatment fluid 40 from the primary source of pressurized treatment fluid 10 towards a rotary surface 62 of the pressure-driven impeller 60 to drive rotation of the helical mixing element 30.

Referring to FIG. 3, it is noted that the external injection ports 34 may also be configured to drive rotation of the helical mixing element 30 in the target viscous medium 50 when the pressurized treatment fluid 40 is injected into the target viscous medium 50. More specifically, the external injection ports 34 may comprise fluidic nozzles, which are illustrated schematically by directional indicators 35 and are configured to tangentially direct the pressurized treatment fluid 40 from a surface 38 of the helical mixing element 30. Although the fluidic nozzles 35 are illustrated solely on the outside diametrical surface of the helical mixing element 30 in FIG. 3, it is noted that similar fluidic nozzles 35 may be provided on the inside diametrical surface of the helical mixing element 30, or on any portion of the helical mixing element 30. It is also noted that the external mixing paddles 36 illustrated in FIG. 2 are excluded from FIG. 3 in order to provide a clear view of the injection of the pressurized treatment fluid 40 without occlusion.

Referring collectively to FIGS. 1-3, the helical mixing element 30 may comprise an open end 31 secured to the rotational fluidic transfer assembly 20 and in fluid communication with the fluidic transfer chamber 26 of the fluidic transfer assembly 20, and a closed end 33 terminating the interior treatment fluid passage 32 of the helical mixing element 30. In embodiments, the helical mixing element 30 is a tubular helical mixing element. The tubular helical mixing element may have a consistent diameter throughout its body. Alternatively, the tubular helical mixing element may have a tapered body to distribute ejection pressure evenly along the length of the tubular element. The helical mixing element 30 may comprise any suitable helical shape. In embodiments, the helical mixing element 30 comprises a conical helix, a circular helix, or a double helix. Regardless of the particular form of the helix chosen, it is contemplated that the helix may be left-handed, right-handed, or, in the case of a double helix, a combination thereof.

In embodiments, the helical mixing element 30 is constructed primarily of an anti-corrosive material under exposure to the target viscous medium 50. It is contemplated, for example, that stainless steel compositions and a variety of plastics may be configured to be anti-corrosive under exposure to the target viscous medium 50. The anti-corrosive material used to construct the helical mixing element 30 may be the same as, or different from, the material used to construct the rotational fluidic transfer assembly 20.

The external mixing paddles 36 of the helical mixing element 30 may be arranged along an outside diameter of the helical mixing element 30, as is illustrated in FIG. 1. In other embodiments, the external mixing paddles 36 of the helical mixing element 30 are arranged along an inside diameter of the helical mixing element 30. In certain embodiments, the external mixing paddles 36 are arranged along both the outside diameter and the inside diameter of the helical mixing element 30. The external mixing paddles 36 may comprise any shape suitable for increasing the mass transfer between the pressurized treatment fluid 40 or the secondary pressurized treatment fluid and the target viscous medium 50. Suitable shapes of the external mixing paddles 36 may include rectangular tabs, circular tabs, semi-circular tabs, or combinations thereof. Regardless of which shape is chosen, it is contemplated that the external mixing paddles 36 increase the mass transfer between the pressurized treatment fluid 40 or the secondary treatment fluid and the target viscous medium 50. In embodiments, the external mixing paddles 36 of the helical mixing element 30 is constructed primarily of an anti-corrosive material under exposure to the target viscous medium 50. The anti-corrosive material used to construct the external mixing paddles 36 may be the same as, or different from, the material used to construct the other elements of the helical mixing element 30.

The rotational fluidic transfer assembly 20 may be constructed primarily of an anti-corrosive material under exposure to the target viscous medium 50. For the purposes of defining and describing the subject matter of the present disclosure, it is noted that an anti-corrosive material is any material that maintains its structural integrity for an extended period of time, e.g., on the order of weeks or months, in a target viscous medium 50 having a pH of above approximately 10 or below approximately 4. It is contemplated, for example, that stainless steel compositions and a variety of plastics may be configured to be anti-corrosive under exposure to the composition of the target viscous medium 50.

It is contemplated that the pressurized treatment fluid 40 may be selected to increase or decrease the pH of the target viscous medium 50. In embodiments where the objective is pH reduction, it may be preferable to reduce the pH of the target viscous medium 50 by at least 3. In such embodiments, the target viscous medium 50 may have a pH between approximately 10 and approximately 13 before it is treated with the pressurized treatment fluid 40. When the objective is pH reduction, although a variety of treatment fluids will be appropriate, it is noted that suitable pressurized treatment fluids 40 may comprise carbon dioxide, hydrogen sulfide, sulfur oxides, hydrochloric acid, hydrofluoric acid, nitric acid, acetic acid, lactic acid, formic acid, citric acid, oxalic acid, uric acid, or combinations thereof.

In embodiments where the objective is pH elevation, it may be preferable to increase the pH of the target viscous medium 50 by at least 3. In such embodiments, the target viscous medium 50 may have a pH between approximately 1 and approximately 4 before it is treated with the pressurized treatment fluid 40. When the objective is pH elevation, although a variety of treatment fluids will be appropriate, it is noted that suitable pressurized treatment fluids 40 may comprise ammonia, potassium hydroxide, calcium hydroxide, sodium hypochlorite, or combinations thereof.

Regardless of the pH of the target viscous medium 50, the pressurized treatment fluid 40 may be injected into the target viscous medium 50 at a volumetric flow rate sufficient to increase or decrease the pH of the target viscous medium 50 to a significant extent, for example, by at least 3. Although a variety of volumetric flow rates will yield satisfactory results, it is contemplated that, in some embodiments, the volumetric flow rate of the pressurized treatment fluid 40 provided by the system 100 for treating the target viscous medium 50 will be at least approximately 16 cubic meters per second ($m^3/s$).

In one class of embodiments, the target viscous medium 50 comprises bauxite tailings and the primary source of pressurized treatment fluid 10 comprises carbon dioxide gas or another fluid that will reduce the pH of the bauxite tailings. As used in this disclosure, "bauxite tailings" are understood to comprise highly alkaline waste products that are generated in the industrial production of alumina. Typically, bauxite tailings comprise a mixture of solid oxides and metallic oxides, including iron oxides, aluminum oxide, titanium oxide, calcium oxide, silicon dioxide, and sodium oxide. In other embodiments, the target viscous medium 50 comprises slag, fly ash, crusher fines, ammonia-soda process waste, chromite ore processing residue, or combinations thereof.

The system 100 for treating a viscous medium may further comprise a secondary source of pressurized treatment fluid in fluidic communication with the fluid outlet 28 of the rotational fluidic transfer assembly 20 via the fluidic transfer chamber 26. The secondary source of pressurized treatment fluid may be configured to increase fluidic injection pressure by introducing a secondary pressurized treatment fluid to the fluidic transfer chamber 26. The secondary source of pressurized treatment fluid may be introduced in line with the primary source of treatment fluid 10 through flow-directing pressurized fluid inlet 27, or independently of the primary source of treatment fluid 10 through a separate flow-directing fluid inlet. In embodiments where a secondary source of pressurized treatment fluid is provided, the pressure-driven impeller 60 and one or both of the primary and secondary sources of pressurized treatment fluid may be collectively configured to drive rotation of the helical mixing element 30 in response to the introduction of pressurized treatment fluid into the rotational fluidic transfer assembly 20.

In embodiments, the pressurized treatment fluid 40 introduced by the primary source of pressurized treatment fluid 10 is characterized by a viscosity that is different from the secondary pressurized treatment fluid introduced by the secondary source of pressurized treatment fluid. More specifically, in some cases, the pressurized treatment fluid 40 may have a relatively high viscosity that is not optimized for treatment of the target viscous medium 50, so a secondary pressurized treatment fluid of relatively low viscosity may be selected to counteract the relatively high viscosity of the pressurized treatment fluid 40 and present a composite treatment fluid that is more readily mixed into the target viscous medium 50. For example, and not by way of limitation, relatively high viscosity treatment fluids may comprise oil residue, concrete mixture, honey, chocolate, or combinations thereof, while relatively low viscosity treatment fluids may comprise methane, ethane, propane, butane, pentane, hexane, water, or combinations thereof.

According to a first aspect of the present disclosure, a system for treating a viscous medium comprises a primary source of pressurized treatment fluid, a rotational fluidic transfer assembly, and a helical mixing element, wherein the rotational fluidic transfer assembly comprises an anchored portion, a rotational portion, a fluidic transfer chamber, a fluid outlet, and a sealed bearing assembly collectively configured to permit rotation of the rotational portion about a rotational axis relative to the anchored portion while maintaining a minimum fluidic injection pressure within the fluidic transfer chamber; the primary source of pressurized treatment fluid is in fluidic communication with the fluid outlet of the rotational fluidic transfer assembly via the fluidic transfer chamber; the helical mixing element comprises an interior treatment fluid passage, external injection ports, and external mixing paddles; the fluid outlet of the rotational fluidic transfer assembly is in fluidic communication with the external injection ports of the helical mixing element via the interior treatment fluid passage of the helical mixing element; and the helical mixing element is mechanically coupled to rotate with the rotational portion of the rotational fluidic transfer assembly.

A second aspect of the present disclosure may include the first aspect, wherein the primary source of pressurized treatment fluid, the rotational fluidic transfer assembly, and the helical mixing element cooperate to permit the injection of the pressurized treatment fluid from the primary source of pressurized treatment fluid through the external injection ports of the helical mixing element, into a target viscous medium in which the helical mixing element is positioned.

A third aspect of the present disclosure may include the first aspect or the second aspect, wherein the primary source of pressurized treatment fluid, the rotational fluidic transfer assembly, and the helical mixing element cooperate to rotate the helical mixing element in a target viscous medium in which the helical mixing element is positioned.

A fourth aspect of the present disclosure may include any of the first through third aspects, wherein the primary source of pressurized treatment fluid, the rotational fluidic transfer assembly, and the helical mixing element cooperate to permit the injection of the pressurized treatment fluid from the primary source of pressurized treatment fluid through the external injection ports of the helical mixing element, into a target viscous medium in which the helical mixing element is positioned and rotate the helical mixing element in the target viscous medium simultaneously with the injection of the pressurized treatment fluid into the target viscous medium.

A fifth aspect of the present disclosure may include any of the first through fourth aspects, wherein the external injection ports are configured to drive rotation of the helical mixing element in the target viscous medium when the pressurized treatment fluid is injected into the target viscous medium.

A sixth aspect of the present disclosure may include any of the first through fifth aspects, wherein the external injection ports comprise fluidic nozzles that are configured to direct the pressurized treatment fluid tangentially from a surface of the helical mixing element.

A seventh aspect of the present disclosure may include any of the first through sixth aspects, wherein the rotational portion of the rotational fluidic transfer assembly comprises a pressure-driven impeller.

An eighth aspect of the present disclosure may include the seventh aspect, wherein the primary source of pressurized treatment fluid and the pressure-driven impeller are collectively configured to drive rotation of the helical mixing element in response to the introduction of the primary pressurized treatment fluid into the rotational fluidic transfer assembly.

A ninth aspect of the present disclosure may include the seventh aspect or eighth aspect, wherein the system further comprises a secondary source of pressurized treatment fluid in fluidic communication with the fluid outlet of the rotational fluidic transfer assembly via the fluidic transfer chamber and the pressure driven impeller and one or both of the primary and secondary sources of pressurized treatment fluid are collectively configured to drive rotation of the helical mixing element in response to the introduction of a secondary pressurized treatment fluid into the rotational fluidic transfer assembly.

A tenth aspect of the present disclosure may include any of the seventh through ninth aspects, wherein the rotational fluidic transfer assembly comprises a flow-directing pressurized fluid inlet that is configured to direct flow of fluid from one or both of the primary and secondary sources of pressurized treatment fluid towards a rotary surface of the pressure-driven impeller to drive rotation of the helical mixing element.

An eleventh aspect of the present disclosure may include any of the first through tenth aspects, wherein the external injection ports are configured to drive rotation of the helical mixing element in the target viscous medium when the pressurized treatment fluid is injected into the target viscous medium; the rotational portion of the rotational fluidic transfer assembly comprises a pressure-driven impeller; and the primary source of pressurized treatment fluid and the pressure-driven impeller are collectively configured to drive rotation of the helical mixing element in response to the introduction of the pressurized treatment fluid into the rotational fluidic transfer assembly.

A twelfth aspect of the present disclosure may include any of the first through eleventh aspects, wherein the pressurized treatment fluid is injected into the target viscous medium at a volumetric flow rate sufficient to decrease the pH of the target viscous medium by at least 3.

A thirteenth aspect of the present disclosure may include any of the first through twelfth aspects, wherein the target viscous medium comprises bauxite tailings and the pressurized treatment fluid comprises carbon dioxide.

A fourteenth aspect of the present disclosure may include any of the first through eleventh aspects, wherein the pressurized treatment fluid is injected into the target viscous medium at a volumetric flow rate sufficient to increase the pH of the target viscous medium by at least 3.

A fifteenth aspect of the present disclosure may include any of the first through fourteenth aspects, wherein the system further comprises a secondary source of pressurized treatment fluid in fluidic communication with the fluid outlet of the rotational fluidic transfer assembly via the fluidic transfer chamber.

A sixteenth aspect of the present disclosure may include the fifteenth aspect, wherein the secondary source of pressurized treatment fluid is configured to increase fluidic injection pressure within the fluidic transfer chamber.

A seventeenth aspect of the present disclosure may include the fifteenth aspect or the sixteenth aspect, wherein the respective viscosities of the pressurized treatment fluid introduced by the primary source of pressurized treatment fluid and the pressurized treatment fluid introduced by the secondary source of pressurized treatment fluid are different.

According to an eighteenth aspect of the present disclosure, a system for treating a viscous medium comprises a primary source of pressurized treatment fluid, a rotational fluidic transfer assembly, and a helical mixing element, wherein the rotational fluidic transfer assembly comprises an anchored portion, a rotational portion, a fluidic transfer chamber, a fluid outlet, and a sealed bearing assembly collectively configured to permit rotation of the rotational portion about a rotational axis relative to the anchored portion while maintaining a minimum fluidic injection pressure within the fluidic transfer chamber; the primary source of pressurized treatment fluid is in fluidic communication with the fluid outlet of the rotational fluidic transfer assembly via the fluidic transfer chamber; the helical mixing element comprises an interior treatment fluid passage, external injection ports, and external mixing paddles; the fluid outlet of the rotational fluidic transfer assembly is in fluidic communication with the external injection ports of the helical mixing element via the interior treatment fluid passage of the helical mixing element; the helical mixing element is mechanically coupled to rotate with the rotational portion of the rotational fluidic transfer assembly; the primary source of pressurized treatment fluid, the rotational fluidic transfer assembly, and the helical mixing element cooperate to permit the injection of pressurized treatment fluid from the primary source of pressurized treatment fluid through the external injection ports of the helical mixing element, into a target viscous medium in which the helical mixing element is positioned and to rotate the helical mixing element in the target viscous medium simultaneously with the injection of the pressurized treatment fluid into the target viscous medium; the viscous medium comprises bauxite tailings; the pressurized treatment fluid comprises carbon dioxide; and the pressurized treatment fluid is injected into the viscous medium at a volumetric flow rate sufficient to decrease the pH of the viscous medium by at least 3.

According to a nineteenth aspect of the present disclosure, a system for treating a viscous medium comprises a primary source of pressurized treatment fluid, a fluidic transfer assembly, and a helical mixing element, wherein the fluidic transfer assembly comprises a fluidic transfer chamber and a fluid outlet the primary source of pressurized treatment fluid is in fluidic communication with the fluid outlet of the fluidic transfer assembly via the fluidic transfer chamber the helical mixing element comprises an interior treatment fluid passage and external injection ports; and the fluid outlet of the fluidic transfer assembly is in fluidic communication with the external injection ports of the helical mixing element via the interior treatment fluid passage of the helical mixing element.

According to a twentieth aspect of the present disclosure, a method for treating a viscous medium comprises submerging a system comprising a primary source of pressurized treatment fluid, a rotational fluidic transfer assembly, and a helical mixing element into the viscous medium, and introducing pressurized treatment fluid to the system, wherein the rotational fluidic transfer assembly comprises an anchored portion, a rotational portion, a fluidic transfer chamber, a fluid outlet, and a sealed bearing assembly collectively configured to permit rotation of the rotational portion about a rotational axis relative to the anchored portion while maintaining a minimum fluidic injection pressure within the fluidic transfer chamber; the primary source of pressurized treatment fluid is in fluidic communication with the fluid outlet of the rotational fluidic transfer assembly via the fluidic transfer chamber; the helical mixing element comprises an interior treatment fluid passage, external injection ports, and external mixing paddles; the fluid outlet of the rotational fluidic transfer assembly is in fluidic communication with the external injection ports of the helical mixing element via the interior treatment fluid passage of the helical mixing element; the helical mixing element is mechanically coupled to rotate with the rotational portion of the rotational fluidic transfer assembly; the pressurized treatment fluid comprises carbon dioxide; and the target viscous medium comprises bauxite tailings and has a pH between approximately 10 and approximately 13 before it is treated with the pressurized treatment fluid.

It is noted that terms like "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the term "approximately" is utilized herein to represent the inherent degree of uncertainty that may be attributed to any quantitative comparison, value, measurement, or other representation. The term "approximately" is also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A system for treating a target viscous medium comprising a primary source of pressurized treatment fluid, a rotational fluidic transfer assembly, and a helical mixing element, wherein:

the rotational fluidic transfer assembly comprises an anchored portion, a rotational portion, a fluidic transfer chamber, a fluid outlet, and a sealed bearing assembly collectively configured to permit rotation of the rotational portion about a rotational axis relative to the anchored portion while maintaining a minimum fluidic injection pressure within the fluidic transfer chamber;

the primary source of pressurized treatment fluid is in fluidic communication with the fluid outlet of the rotational fluidic transfer assembly via the fluidic transfer chamber;

the helical mixing element comprises an interior treatment fluid passage, external injection ports, and external mixing paddles;

the fluid outlet of the rotational fluidic transfer assembly is in fluidic communication with the external injection ports of the helical mixing element via the interior treatment fluid passage of the helical mixing element; and the helical mixing element is mechanically coupled to rotate with the rotational portion of the rotational fluidic transfer assembly.

2. The system of claim 1, wherein the primary source of pressurized treatment fluid, the rotational fluidic transfer assembly, and the helical mixing element cooperate to permit the injection of the pressurized treatment fluid from the primary source of pressurized treatment fluid through the external injection ports of the helical mixing element, into a target viscous medium in which the helical mixing element is positioned.

3. The system of claim 1, wherein the primary source of pressurized treatment fluid, the rotational fluidic transfer assembly, and the helical mixing element cooperate to rotate the helical mixing element in a target viscous medium in which the helical mixing element is positioned.

4. The system of claim 1, wherein the primary source of pressurized treatment fluid, the rotational fluidic transfer assembly, and the helical mixing element cooperate to:

permit the injection of the pressurized treatment fluid from the primary source of pressurized treatment fluid through the external injection ports of the helical mixing element, into a target viscous medium in which the helical mixing element is positioned; and rotate the helical mixing element in the target viscous medium simultaneously with the injection of the pressurized treatment fluid into the target viscous medium.

5. The system of claim 1, wherein the external injection ports are configured to drive rotation of the helical mixing element in the target viscous medium when the pressurized treatment fluid is injected into the target viscous medium.

6. The system of claim 5, wherein the external injection ports comprise fluidic nozzles that are configured to direct the pressurized treatment fluid tangentially from a surface of the helical mixing element.

7. The system of claim 1, wherein the rotational portion of the rotational fluidic transfer assembly comprises a pressure-driven impeller.

8. The system of claim 7, wherein the primary source of pressurized treatment fluid and the pressure-driven impeller are collectively configured to drive rotation of the helical mixing element in response to the introduction of the primary pressurized treatment fluid into the rotational fluidic transfer assembly.

9. The system of claim 7, wherein:

the system further comprises a secondary source of pressurized treatment fluid in fluidic communication with the fluid outlet of the rotational fluidic transfer assembly via the fluidic transfer chamber; and the pressure driven impeller and one or both of the primary and secondary sources of pressurized treatment fluid are collectively configured to drive rotation of the helical mixing element in response to the introduction of a secondary pressurized treatment fluid into the rotational fluidic transfer assembly.

10. The system of claim 9, wherein the rotational fluidic transfer assembly comprises a flow-directing pressurized fluid inlet that is configured to direct flow of fluid from one or both of the primary and secondary sources of pressurized treatment fluid towards a rotary surface of the pressure-driven impeller to drive rotation of the helical mixing element.

11. The system of claim 1, wherein:

the external injection ports are configured to drive rotation of the helical mixing element in the target viscous medium when the pressurized treatment fluid is injected into the target viscous medium;

the rotational portion of the rotational fluidic transfer assembly comprises a pressure-driven impeller; and the primary source of pressurized treatment fluid and the pressure-driven impeller are collectively configured to drive rotation of the helical mixing element in response to the introduction of the pressurized treatment fluid into the rotational fluidic transfer assembly.

12. The system of claim 1, wherein the pressurized treatment fluid is injected into the target viscous medium at a volumetric flow rate sufficient to decrease the pH of the target viscous medium by at least 3.

13. The system of claim 1, wherein:

the target viscous medium comprises bauxite tailings; and the pressurized treatment fluid comprises carbon dioxide.

14. The system of claim 1, wherein the pressurized treatment fluid is injected into the target viscous medium at a volumetric flow rate sufficient to increase the pH of the target viscous medium by at least 3.

15. The system of claim 1, wherein the system further comprises a secondary source of pressurized treatment fluid in fluidic communication with the fluid outlet of the rotational fluidic transfer assembly via the fluidic transfer chamber.

16. The system of claim 15, wherein the secondary source of pressurized treatment fluid is configured to increase fluidic injection pressure within the fluidic transfer chamber.

17. The system of claim 15, wherein the respective viscosities of the pressurized treatment fluid introduced by the primary source of pressurized treatment fluid and the pressurized treatment fluid introduced by the secondary source of pressurized treatment fluid are different.

18. A system for treating a target viscous medium comprising a primary source of pressurized treatment fluid, a rotational fluidic transfer assembly, and a helical mixing element, wherein:

the rotational fluidic transfer assembly comprises an anchored portion, a rotational portion, a fluidic transfer chamber, a fluid outlet, and a sealed bearing assembly collectively configured to permit rotation of the rotational portion about a rotational axis relative to the anchored portion while maintaining a minimum fluidic injection pressure within the fluidic transfer chamber;

the primary source of pressurized treatment fluid is in fluidic communication with the fluid outlet of the rotational fluidic transfer assembly via the fluidic transfer chamber;

the helical mixing element comprises an interior treatment fluid passage, external injection ports, and external mixing paddles;

the fluid outlet of the rotational fluidic transfer assembly is in fluidic communication with the external injection ports of the helical mixing element via the interior treatment fluid passage of the helical mixing element;

the helical mixing element is mechanically coupled to rotate with the rotational portion of the rotational fluidic transfer assembly;

the primary source of pressurized treatment fluid, the rotational fluidic transfer assembly, and the helical mixing element cooperate to permit the injection of pressurized treatment fluid from the primary source of pressurized treatment fluid through the external injection ports of the helical mixing element, into a target viscous medium in which the helical mixing element is positioned and to rotate the helical mixing element in the target viscous medium simultaneously with the injection of the pressurized treatment fluid into the target viscous medium;

the target viscous medium comprises bauxite tailings;

the pressurized treatment fluid comprises carbon dioxide; and the pressurized treatment fluid is injected into the target viscous medium at a volumetric flow rate sufficient to decrease the pH of the target viscous medium by at least 3.

19. A method for treating a target viscous medium, the method comprising submerging a system comprising a primary source of pressurized treatment fluid, a rotational fluidic transfer assembly, and a helical mixing element into the target viscous medium, and introducing pressurized treatment fluid to the system, wherein:

the rotational fluidic transfer assembly comprises an anchored portion, a rotational portion, a fluidic transfer chamber, a fluid outlet, and a sealed bearing assembly collectively configured to permit rotation of the rotational portion about a rotational axis relative to the anchored portion while maintaining a minimum fluidic injection pressure within the fluidic transfer chamber;

the primary source of pressurized treatment fluid is in fluidic communication with the fluid outlet of the rotational fluidic transfer assembly via the fluidic transfer chamber;

the helical mixing element comprises an interior treatment fluid passage, external injection ports, and external mixing paddles;

the fluid outlet of the rotational fluidic transfer assembly is in fluidic communication with the external injection ports of the helical mixing element via the interior treatment fluid passage of the helical mixing element;

the helical mixing element is mechanically coupled to rotate with the rotational portion of the rotational fluidic transfer assembly;

the pressurized treatment fluid comprises carbon dioxide; and the target viscous medium comprises bauxite tailings and has a pH between approximately 10 and approximately 13 before it is treated with the pressurized treatment fluid.

20. A method for treating a target viscous medium comprising bauxite tailings, the method comprising submerging a rotational fluidic transfer assembly and a helical mixing element into the target viscous medium comprising bauxite tailings, and introducing pressurized treatment fluid from a primary source of pressurized treatment fluid into the target viscous medium via the rotational fluidic transfer assembly and the helical mixing element, wherein:

the rotational fluidic transfer assembly comprises a fluidic transfer chamber and a fluid outlet;

the primary source of pressurized treatment fluid comprises carbon dioxide and is in fluidic communication with the fluid outlet of the fluidic transfer assembly via the fluidic transfer chamber;

the helical mixing element comprises an interior treatment fluid passage and external injection ports; and the fluid outlet of the fluidic transfer assembly is in fluidic communication with the external injection ports of the helical mixing element via the interior treatment fluid passage of the helical mixing element.

* * * * *